United States Patent [19]

Sheerer

[11] Patent Number: 4,802,781

[45] Date of Patent: Feb. 7, 1989

[54] DOT MATRIX PRINTER HAVING INCREASED IMPACT FORCE AND HIGHER OPERATING FREQUENCY

[75] Inventor: Thomas J. Sheerer, Troy, Tex.

[73] Assignee: Texas Instruments Incorporated, Dallas, Tex.

[21] Appl. No.: 89,879

[22] Filed: Aug. 27, 1987

[51] Int. Cl.[4] ..... B41J 3/12

[52] U.S. Cl. ..... 400/124; 101/93.05

[58] Field of Search ..... 400/121, 124; 101/93.04, 93.05

[56] References Cited

U.S. PATENT DOCUMENTS

| | | | |
|---|---|---|---|
| 4,255,062 | 3/1981 | Hendrischk | 400/124 |
| 4,415,909 | 11/1983 | Italiano | 346/140 R |
| 4,473,311 | 9/1984 | Sakaida | 400/124 |
| 4,547,085 | 10/1985 | Ochiai | 400/124 |
| 4,652,158 | 3/1987 | Asano | 400/124 |

FOREIGN PATENT DOCUMENTS

| | | | |
|---|---|---|---|
| 209887 | 11/1984 | Japan | 400/124 |
| 76376 | 4/1986 | Japan | 400/124 |
| 229565 | 10/1986 | Japan | 400/124 |

*Primary Examiner*—Paul T. Sewell

*Attorney, Agent, or Firm*—Thomas G. Devine; James T. Comfort; Melvin Sharp

[57] ABSTRACT

The disclosure relates to a method of making a print head and the print head for a dot matrix printer, wherein there is provided a print wire actuator housing, a plurality of print wire actuators disposed in the housing, the actuators being arranged in the housing at points therein defined by (a) locating in a plane N parallel spaced lines, where N is an odd positive integer, (b) locating a point on the (N+1)/2 line from an extreme one of the lines, (c) defining points on a first arc of a circle having a center of curvature in the direction of the point and passing through the odd ones of the N lines at angles of (360 degrees/N)×A with the (N+1)/2 line, where A is an integer from 0 to N and (d) defining points on a second arc of a circle having a center of curvature in the direction of the point and on the opposite side of the point as the first arc and passing through the even ones of the N lines at angles of (360 degrees/N)×A with the (N+1)/2 line, where A is an integer from 0 to N.

12 Claims, 2 Drawing Sheets

DOT MATRIX PRINTER HAVING INCREASED IMPACT FORCE AND HIGHER OPERATING FREQUENCY

BACKGROUND OF THE INVENTION

Field of the Invention

This invention relates to dot matrix printers and, more specifically, to the construction of the print head therefor.

SUMMARY OF THE PRIOR ART

Presently used dot matrix print heads consist of several actuator mechanisms arranged in a radial manner, each actuator mechanism having and actuating a print wire to impart a force to a ribbon and paper arrangement via the print wire. The print wires are designed to strike the ribbon in a vertical line. In this manner, a character is formed by actuating predetermined ones of the print wires in each vertical line over a predetermined number of such vertical lines. Since a character to be formed is stored as a two dimensional matrix of dot locations, the print wires are directed by wire guides into the one or more vertical columns at the printing end of the print head. This arrangement achieves the results that (1) the wires are aligned at the inter-dot vertical spacing required for printing dot matrix characters, (2) the vertical alignment simplifies the electronics required to acutate the print head since, for any verticcal row of dots in a character, all dots are printed simultaneously and (3) the physical distance moved by the print wires to print a character is minimized.

In a serial dot matrix print head of the stored energy type, a soft iron magnetic circuit including a permanent magnet is used to pull the end of a cantilever beam type armature toward a pole. The cantilever beam is released from the deflected position by an actuator coil which locally cancels the magnetic field of the permanent magnet when current is passed therethrough. On release, the cantilever beam accelerates toward its relaxed position, converting the strain energy of the beam into kinetic energy. Force is transmitted to a ribbon and paper system by means of a print wire which is attached to and moves with the armature, the print wire passing through several wire guides. The wire guides direct the wires from several actuator circuits into one or more vertical columns. The actuators are arranged in a circular or near-circular array to maximize the available space for each actuator. The wire guides must be so positioned and of such number that the forces exerted on the wires are insufficient to buckle the wires. The force required for buckling decreases as the distance between supports increases.

There are two consequences of the above described arrangement. First, the elasticity of the print wire has a significant effect on the duration and amplitude of the impact on the ribbon/paper system. The effect of elastic deformation of the wire is to increase the duration of the impact and reduce amplitude in comparison with the results obtainable for a rigid body collision. Energy is therefore expended on the wire which would otherwise be available for ink transfer at the ribbon. Secondly, the wire guides generate reaction forces against the print wires, resulting in frictional drag. This is greatly increased as the wire is deformed elastically during operation. The consequent loss in wire velocity reduces both impact forces and printing speed.

SUMMARY OF THE INVENTION

In order to eliminate or minimize the losses of the type described hereinabove while maintaining a pattern of print wires suitable for character generation and maximizing the space available for actuator cells, a printhead is used having wires of sufficiently small length to eliminate buckling in the absence of any supports therefor. It is not possible to do this while maintaining a vertical row of print wires, however it is possible to maintain the essential condition that the vertical wire spacing be equal to the vertical dot spacing required from the printer. The horizontal scatter of the wires must be minimized to reduce the printhead travel required to print a character. This is achieved by using short print wires whose loci are the intersections of N, equally spaced, horizontal lines and N equally angled radials from a point on the center horizontal line of angle 360 degrees/N where N is the number of print wires required. This maximizes angular separation of the actuator cells while maintaining the essential requirement for printing of correct vertical spacing. The above noted loci lie on two arcs of different radii. The loci do not coincide with the matrix overlay, however, with very small modificatons, the loci will fall onto a 60 or 120 dot/inch overlay, for example, without significantly reducing the space available for actuator cells. The same above described method can be applied for any number of print wires and any overlay.

In order to print formed characters, since the print wires which form a vertical line are not positioned in a vertical line, it is necessary to delay activation of a print wire by an amount proportional to their displacement from the most remote wire from the locus of wires. By placing the wires on a grid, it is possible to do this digitally, using a buffer or counter type of circuit. A different buffer is required for printing left to right as opposed to printing right to left. If the printer has carriage velocity v and horizontal dot density n, then the buffer must be clocked at a rate of $n \times v$. This is also the rate required to clock a conventional dot matrix printer with half dot capability. The length of the delay required is a different number of counts for the different print wires.

DESCRIPTION OF THE PREFERRED EMBODIMENT

Figure 1:
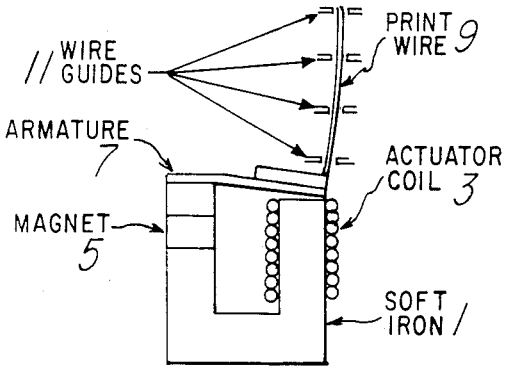
FIG. 1 is a schematic diagram of a prior art stored energy print head cell.

Referring first to FIG. 1, there is shown a single cell of a matrix print head. The cell includes a U-shaped soft iron member 1 having an actuator coil 3 around one leg of the "U". A magnet 5 is located in the soft iron member in the leg opposite the coil 3 to provide a magnetic field is the soft iron. An armature 7 is secured to the end of the leg of the U-shaped member 1 containing the magnet, the armature being cantilevered therefrom and extending over the end portion of the other leg of the "U". Armature is attracted to said other leg by the magnetic field, against the normal bias thereof. A print wire 9 is secured to the armature 7, travels along therewith and extends between wire guides 11 which guide the path of the wire toward a print ribbon (not shown).

In operation, upon actuation of the coil 3, the magnetic field set up by the magnet 5 in the local area of the coil is cancelled, thereby permitting the armature 7 to move away from the soft iron member 1 to its normal unbiased position, thereby causing the print wire 9 to travel along the path determined by the wire guides 11 to strike the ribbon and cause a dot to be formed on the paper behind the ribbon. After movement, the armature returns to its biased position as shown in FIG. 1 since the local magnetic field will again be present until the coil 3 is again energized.

Figure 2A:
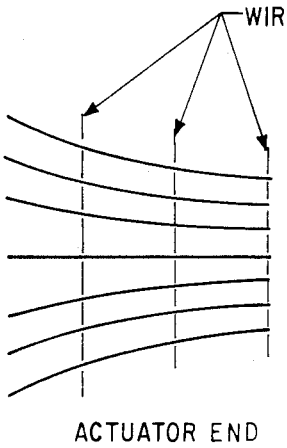
FIG. 2*a* is a schematic diagram showing the deflection of the print wires into a vertical array from the actuator end of a prior art print head.
Figure 2B:
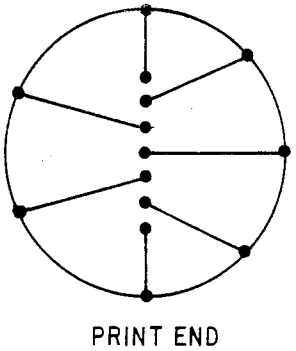
FIG. 2*b* is a schematic diagram as in FIG. 2*a* taken from the print end.

Referring now to FIG. 2*a*, there is shown the standard prior art print head having wire guides 11 associated with each of the print wires 9. As is apparent from FIG. 2*b*, the actuator ends of the print wires 9 commence from points along a circle 13, the print ends of the print wires terminating along a straight line 15 under the direction of the wire guides 11.

As stated hereinabove, in order to provide the above noted advantages over the prior art, the actuators are positioned along horizontal equally spaced lines as in the prior art. The position of each actuator on one of the horizontal lines is determined as follows. Starting from a point 21 on the middle one of the horizontal lines 23 or needle 5 (assuming nine such horizontal lines) in FIG. 3, a line 25 is drawn which makes an angle 27 with the line 23 of 360 degrees divided by the number of horizontal lines on which actuators will be located, this being 360/9 or 40 degrees in the embodiment of FIG. 3. Accordingly, angle 27 will be 40 degrees. Additional lines are drawn from point 21 which make an angle of 40 degrees with the line previously drawn as shown at angle 29, such 40 degree apart lines continuing to be drawn for the full 360 degrees about point 21. It can be seen that each of the lines will commence at point 21 and cross the horizontal lines denoted as needles 1 through 4 or 6 through 9. The point at which line 25 crosses the horizontal line denoted as needle 3 will become an actuator location. Also, the point at which line 31 crosses the needle 1 line will become a second actuator location. The continuing lines (not shown) which are 40 degrees apart will now determine actuator locations on needle lines 2, 4, 6 and 8 successively whereas the lines thereafter will determine the actuator locations on needle lines 9 and 7. It can be seen that the actuator locations on lines 1, 3, 7 and 9 lie along an arc of a circle, the actuator on line 5 then being placed on the same circle. Also, the actuator locations on lines 2, 4, 6 and 8 lie along an arc of a second circle of smaller radius than the first circle. Ideally, actuators, such as, for example, the type of FIG. 1, are placed at the actuator locations depicted in FIG. 3. In practice, it has been found that highly satisfactory results are also obtained by moving each of the actuators horizontally to the closest horizontal line of the matrix as shown in FIG. 4 wherein the actuator locations as depicted in FIG. 3 have been so shifted.

Figure 3:
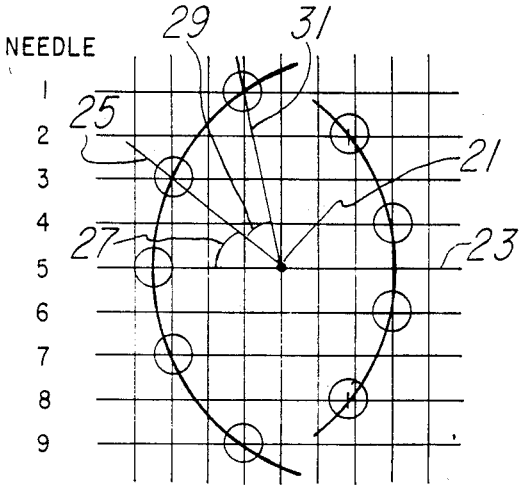
FIG. 3 is a schematic diagram showing the optimum print wire geometry for a nine wire print head.
Figure 4:
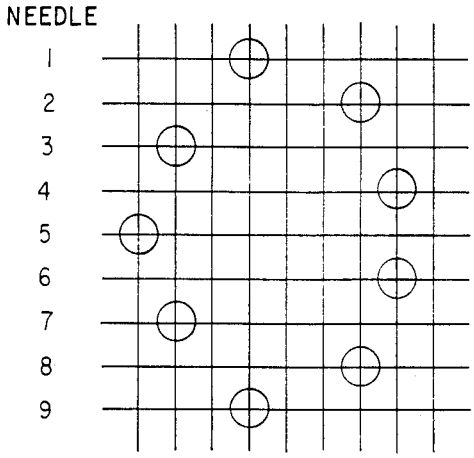
FIG. 4 is a schematic diagram as in FIG. 3 with the dot loci displaced to fall on grid lines.

Since the print wires as arranged in FIGS. 3 or 4 will not be guided to form a straight line with each other as in the prior art, but rather will travel by the shortest path to the print ribbon, buffers (not shown) are provided in the circuit of the coil 3 of each of the printhead cells to delay actuation thereof. For this reason the print wires will all strike in a vertical line though not so positioned and not striking the ribbon at the same time. For instance, in the example shown in FIG. 4, the relative delays are as follows:

| Position | Number of Pulses Delayed Relative to Position 5 |
|---|---|
| 1 | 6 |
| 2 | 12 |
| 3 | 2 |
| 4 | 14 |
| 5 | 0 |
| 6 | 14 |
| 7 | 2 |
| 8 | 12 |
| 9 | 6 |

Figure 5:
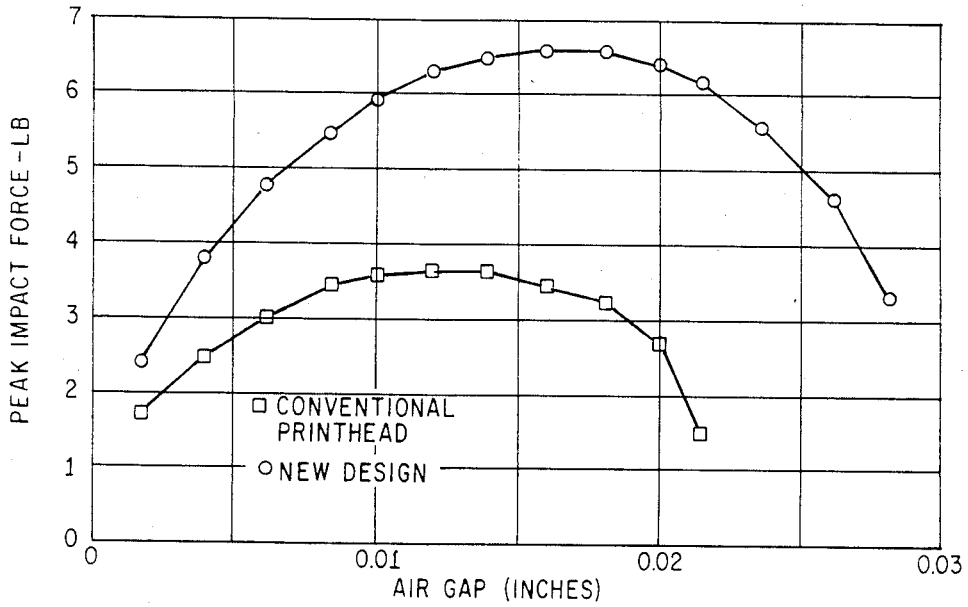
FIG. 5 is a graph showing impact forces versus air gap for conventional print heads as well as for the print head in accordance with the present invention.
Figure 6:
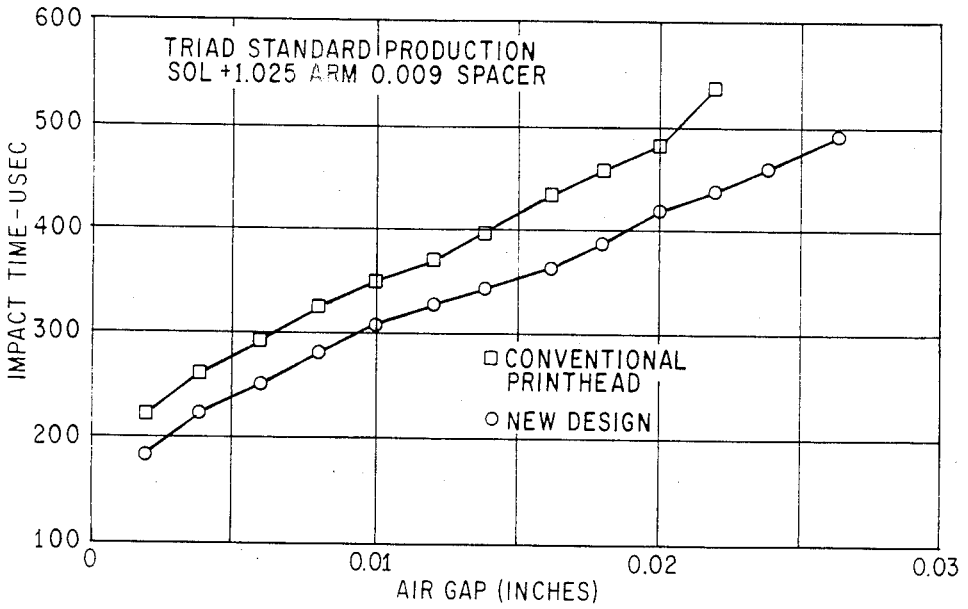
FIG. 6 is a graph showing impact time versus air gap for conventional print heads as well as for the print head in accordance with the present invention.

The impact force, flight time and forms printing capability of a conventional printhead was tested against a print head constructed in accordance with the present invention as shown in FIG. 4. The tests were repeated with the same print head after removal of the wire guide and reduction of the needle length below the calculated buckling length. FIGS. 5 and 6 show impact force on a steel transducer and flight time to the transducer for the standard unit and the same unit with successively shorter wire lengths. It is seen that impact force is approximately doubled while flight time is reduced by approximately 25%. The modified print head in accordance with the present invention was found able to print acceptably on heavy multipart forms beyond the original capabilities of the print head.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

I claim:

1. A method of positioning print wire actuators for a dot matrix printer, comprising the steps of:

(a) locating in a plane N parallel spaced lines, where N is an odd positive integer;

(b) locating a point on the $(N+1)/2$ line from an extreme one of said lines;

(c) defining points on a first arc of a circle having a center of curvature in the direction of said point and passing through the odd ones of said N lines at angles of $(360 \text{ degrees}/N) \times A$ with said $(N+1)/2$ line, where A is an integer from 0 to N;

(d) defining points on a second arc of a circle having a center of curvature in the direction of said point and on the opposite side of said point as said first arc and passing through the even ones of said N lines at angles of $(360 \text{ degrees}/N) \times A$ with said (N+1)/2 line, where A is an integer from 0 to N; and (e) placing print wire actuators at said points.

2.The method of claim 1 wherein said N parallel lines are equally spaced from each other.

3. The method of claim 1, further including locating in said plane M parallel spaced lines normal to said N lines, said actuators being disposed at an intersection of an M line and an N line.

4. The method of claim 2, further including locating in said plane M parallel spaced lines normal to said N lines, said actuators being disposed at an intersection of an M line and an N line.

5. The method of claim 3 wherein said M lines are equally spaced from each other.

6. The method of claim 4 wherein said M lines are equally spaced from each other.

7. A print head for a dot matrix printer, comprising:

(a) a print wire actuator housing;

(b) a plurality of print wire actuators disposed in said housing, said actuators being arranged in said housing at points therein defined by :

(c) locating in a plane N parallel spaced lines, where N is an odd positive integer;

(d) locating a point on the (n+1)/2 line from an extreme one of said lines;

(e) defining points on a first arc of a circle having a center of curvature in the direction of said point and passing through the odd ones of said N lines at angles of (360 degrees/N)×A with said (N+1)/2 line, where A is an integer from 0 to N; and (f) defining points on a second arc of a circle having a center of curvature in the direction of said point and on the opposite side of said point as said first arc and passing through the even ones of said N lines at angles of (360 degrees/N)×A with said (N+1)/2 line, where A is an integer from 0 to N.

8. The print head of claim 7 wherein said N parallel lines are equally spaced from each other.

9. The print head of claim 7, further including locating in said plane M parallel spaced lines normal to said N lines, said actuators being disposed at an intersection of an M line and an N line.

10. The print head of claim 8, further including locating in said plane M parallel spaced lines normal to said N lines, said actuators being disposed at an intersection of an M line and an N line.

11. The print head of claim 9 wherein said M lines are equally spaced from each other.

12. The print head of claim 10 wherein said M lines are equally spaced from each other.

* * * * *